US005715322A

United States Patent [19]

Yoshioka et al.

[11] Patent Number: 5,715,322

[45] Date of Patent: Feb. 3, 1998

[54] THROAT DEVICE INTERCONNECTING A PLURALITY OF DRIVE UNITS AND A HORN

[75] Inventors: Tsutomu Yoshioka; Tsuyoshi Takagi; Hiroshi Kubota, all of Hyogo-ken, Japan

[73] Assignee: TOA Corporation, Hyogo-Ken, Japan

[21] Appl. No.: 767,696

[22] Filed: Dec. 17, 1996

Related U.S. Application Data

[63] Continuation of Ser. No. 387,975, Feb. 8, 1995, abandoned, which is a continuation of Ser. No. 110,918, Aug. 24, 1993, abandoned.

[30] Foreign Application Priority Data

Aug. 25, 1992 [JP] Japan ..... 4-250623

[51] Int. Cl.[6] ..... H04R 25/00

[52] U.S. Cl. ..... 381/182; 381/156; 181/144; 181/147; 181/152

[58] Field of Search ..... 381/156, 182; 181/141, 147, 152, 144, 199, 145, 159, 153, 189

[56] References Cited

U.S. PATENT DOCUMENTS 4,629,029 12/1986 Gunness ..... 181/144

*Primary Examiner*—Sinh Tran

*Attorney, Agent, or Firm*—Townsend and Townsend and Crew LLP

[57] ABSTRACT

A throat device for interconnecting at least two drive units and a horn is provided. The throat device comprises a substantially straight body member having one end to be coupled with the horn, and at least two curved branch members coupled with the other end of said body member such that no phase interference occurs in a high frequency sound range.

5 Claims, 5 Drawing Sheets

THROAT DEVICE INTERCONNECTING A PLURALITY OF DRIVE UNITS AND A HORN

This is a Continuation of application Ser. No. 08/387,975, filed Feb. 8, 1995, now abandoned, the disclosure of which is incorporated by reference, which is a Continuation of application Ser. No. 08/110,918, filed Aug. 24, 1993, now abandoned.

BACKGROUND OF THE INVENTION

1. Field of the Invention

The present invention relates to a throat device provided between a horn of a horn speaker and a drive unit, and, more particularly, to a means for coupling a plurality of drive units to a horn.

2. Description of the Prior Art

Generally, a plurality of drive units may be used for driving a horn speaker with a high electric power. For example, a throat device 10 as shown in FIG. 1 has been used. This throat device 10 has a top end coupled with a horn 12 and curved branch members 14, 16 which are respectively bent in opposite directions to form a letter J shape. The end portions of the branch members 14, 16 are respectively coupled with drive units 18, 20 to which electric power is supplied from a power amplifier (not illustrated).

FIG. 2 shows another type of a throat device 22 provided with branch members 24, 26 which are bent at right angles to form, at the bent portions, reflecting surfaces 28, 30 respectively inclined at 45 degrees with respect to the axial line of the horn 12. The drive units 18, 20 are coupled to the end portions of the branch members 24, 26.

FIG. 3 to FIG. 5 show still another type of a throat device 32 having branch members 33, 34 which are gradually curved. In FIG. 3 to FIG. 5, numerals 36, 38 designate flanges for coupling to drive units and numeral 40 designates a flange for coupling to a horn 42.

However, it should be noted that the throat device 10 shown in FIG. 1 is disadvantageous in that the length of sound-wave propagation paths indicated by a dotted line and a solid line is different due to the existence of the bent portions and a phase difference and a power loss may be generated in a higher frequency sound region.

The throat device 22 shown in FIG. 2 does not generate a power loss resulting from such a difference in propagation path length, unlike the throat device shown in FIG. 1, due to the existence of the reflecting surfaces 28, 30, but the throat device 22 presents a problem that a value of W1 shown in FIG. 2 becomes large thereby restricting the control of horn directivity, because the provision of the reflecting surfaces 28, 30 requires a large ratio of (a sectional area of the throat following the reflecting surface)/(a sectional area of the throat prior to the reflecting surface) so that a sectional area of the throat device 22 is not compressed at the positions where the reflecting surfaces 28, 30 are provided.

Unlike the throat device 10 of FIG. 1, the throat device 32 shown in FIG. 3 to FIG. 5 exhibits less power loss resulting from difference in propagation path length at the bent portions and does not give rise to the above described problem because the throat device 32 includes no compressed portion in its sectional area, unlike the throat device 22 shown in FIG. 2. However, as shown in FIG. 4, if a sound wave is propagated along a line running at an angle θ with respect to the axial lines of the branch portions 33, 34 at a transition from the throat 32 to the horn 42, a path difference d×sin θ (d: distance between the axial lines) is produced and phase intereference can be easily generated.

SUMMARY OF THE INVENTION

The present invention has as its object the provision of a throat device which can solve the problems explained above.

In view of achieving the object described above, a throat device for interconnecting at least two drive units and a horn is provided. The throat device of the present invention comprises:

a substantially straight body member having one end to be coupled with the horn; and at least two curved branch members coupled with the other end of the body member such that no phase interference occurs in a high frequency sound range.

In accordance with an embodiment of the throat device according to the present invention, the horn has a rectangular cross section in a plane perpendicular to a direction of propagation of a sound wave and the branch members branch from the body member in directions parallel to the shorter sides of the rectangular cross section.

In accordance with another embodiment of a throat device according to the present invention, each of the branch members has a first portion to be coupled to a drive unit and a second portion coupled to the first portion at an obtuse angle for interconnecting the first portion and the body member.

In this embodiment, the height of a transverse sectional area at the interconnection of the first and second portions is less than ½ the wavelength of a maximum reproduction frequency of the horn.

In a throat device of the present invention, the height of a transverse sectional area in the vicinity of the coupling area between the branch members and the body member is set to be small and therefore phase intereference is not easily generated. In addition, since a distance d between axial lines measured at the coupling area is set to be short, if a sound wave propagates along a line running at an angle θ with respect to the axial line, a propagation path difference is expressed by d×sin θ. But, since d is short, no large phase intereference is generated.

In a throat device of the present invention, the height of a transverse sectional area at the interconnection of the first and second portions is set experimentally to less than ½ the wavelength of a maximum reproduction frequency of the horn. As a result, it has been confirmed that substantially no phase interference is generated even at the maximum reproduction frequency.

BRIEF DESCRIPTION OF THE DRAWINGS

These and other objects as well as advantages of the present invention will become clear by the following description of a preferred embodiments of the present invention with reference to the accompanying drawings, wherein.

DESCRIPTION OF THE PREFERRED EMBODIMENTS

Figure 1:
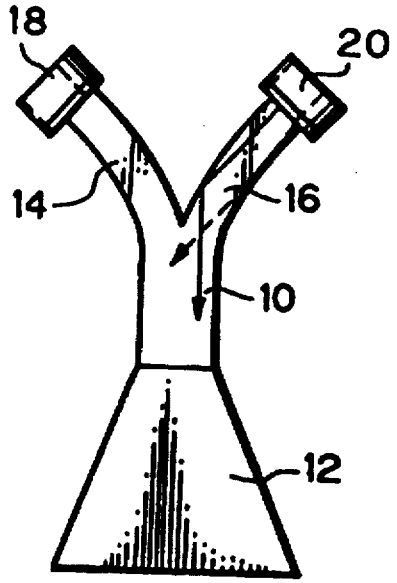
Fig. 1 PRIOR ART
FIG. 1 is a front elevation of an example of a throat device of the prior art.
Figure 2:
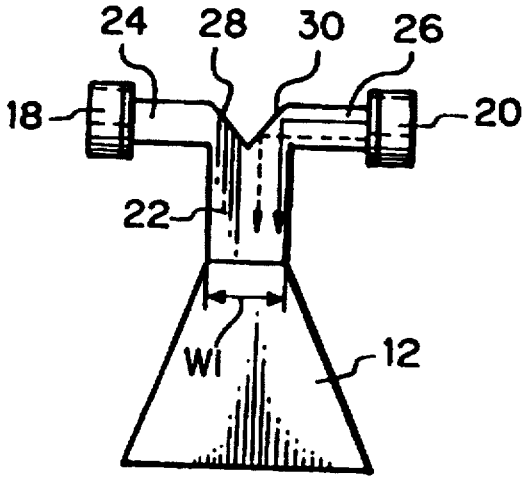
Fig. 2 PRIOR ART
FIG. 2 is a front elevation of another example of a throat device of the prior art.
Figure 3:
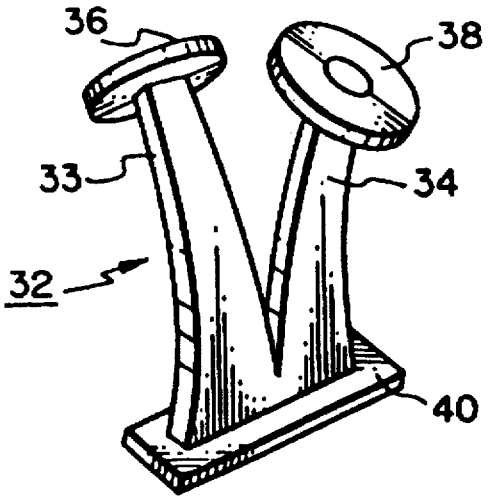
Fig. 3 PRIOR ART
FIG. 3 is a perspective view of other example of a throat device of the prior art.
Figure 4:
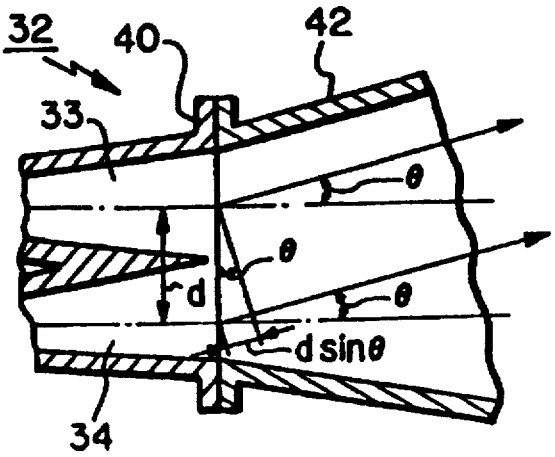
Fig. 4 PRIOR ART
FIG. 4 is a partial vertical sectional view of an essential portion of the throat device of FIG. 3.
Figure 5:
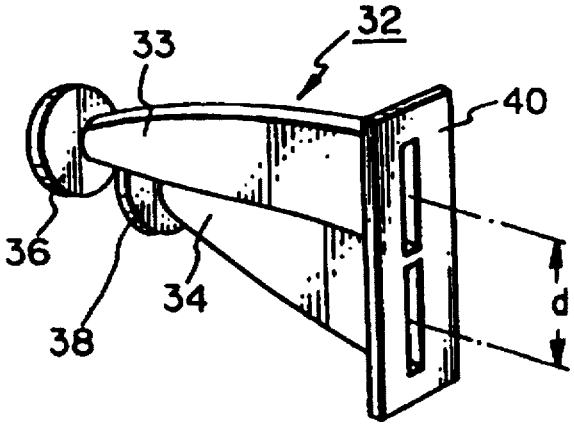
Fig. 5 PRIOR ART
FIG. 5 is a different perspective view of the throat device of FIG. 3.
Figure 6:
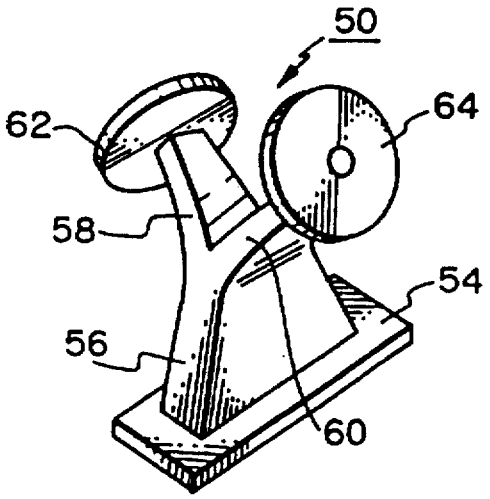
FIG. 6 is a perspective view of a first embodiment of a throat device of the present invention.
Figure 7:
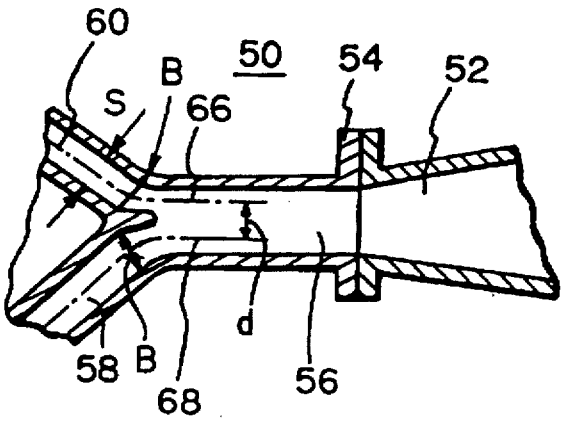
FIG. 7 is a partial vertical side sectional view of an essential portion of the throat device of the first embodiment.
Figure 8:
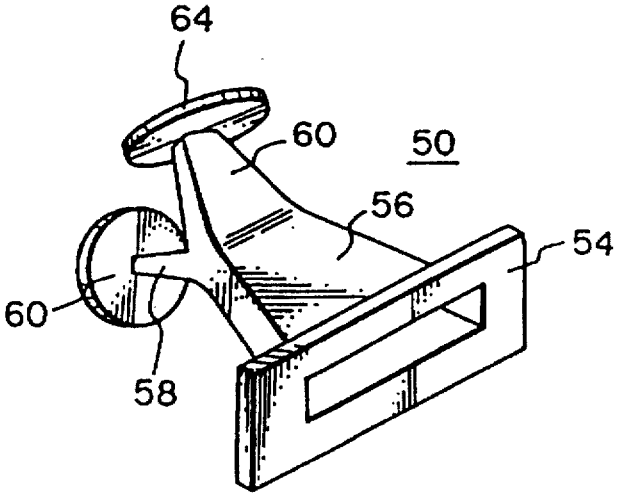
FIG. 8 is a different perspective view of the throat device of the first embodiment.

A throat device 50 of the first embodiment of the present invention is shown in FIG. 6 to FIG. 8. This throat device 50 is substantially shaped in the form of a letter Y as shown in FIG. 7 and has a flange 54 for coupling with a horn 52 shown in FIG. 7. A hollow body 56 is extended substantially straight from the flange 54. Hollow branch members 58, 60 are integrally connected to the end portion of the hollow body 56. At end portions of the branch members 58, 60 are formed flanges 62, 64 for coupling with drive units.

The hollow body 56 is formed such that the width thereof is gradually expanded along the axial line and the branch members 58, 60 are provided to form obtuse angles with respect to the hollow body 56. In other words, the branch members 58, 60 are mounted to protrude obliquely from the body 56. No compressed area exists in the sectional area at the interconnection of the branch members 58, 60 and the hollow body 56.

The vertical height S (FIG. 7) of each branch member 58, 60 in the vicinity of the bent portion is set smaller than the width of the body 56. The axial lines 66, 68 pass through the centers of the cross sections of the branch members 58, 60, is perpendicular to the boundary between the branch members 58, 60 and the hollow body 56, and become parallel with the center line of the body 56 while the distance d between the axial lines 66, 68 measured on the boundary is kept constant. The distance d is set shorter than that of the prior art. That is, the height S and the distance d selected to be smaller than a wavelength of a maximum reproduction frequency.

In the throat device 50 of this embodiment, a sound wave generated from the drive units attached to the flanges 62, 64 propagates within the branch members 58, 60 and the hollow body 56 and reaches the horn 52. Since the vertical height S of the branch members 58, 60 is set small, no phase intereference is easily generated at the bending portions of the branch members 58, 60. Furthermore, since the vertical sections have no compressed portion at the bent portions, the throat device 50 does not suffer from any adverse performance in a high frequency range. Since the distance d between the axial lines 66, 68 is short within the hollow body 56, when a sound wave propagates within the body 56 in the direction forming the angle θ with respect to the axial lines 66, 68, a path difference d sin θ is generated, but a value of d×sin θ itself is small because of a small and substantially no phase interference is generated.

Figure 9:
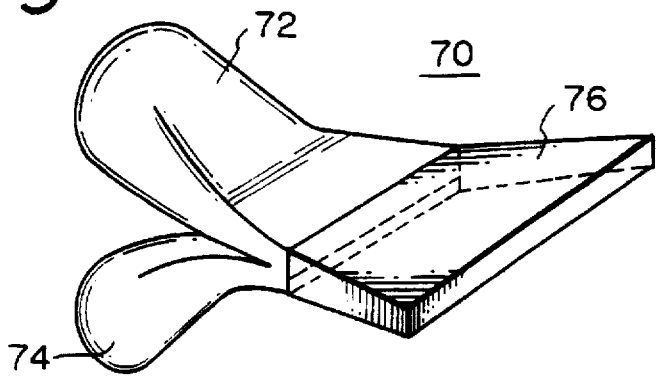
FIG. 9 is a perspective view of a second embodiment of a throat device according to the present invention.
Figure 10A:
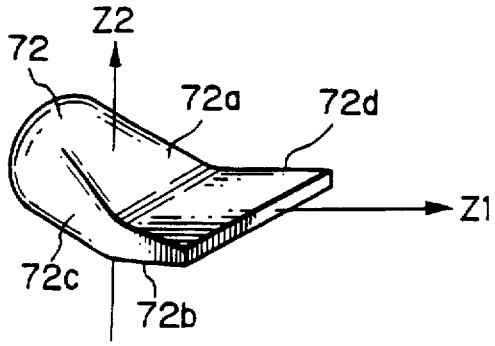
FIG. 10(*a*) is a perspective view of the second embodiment and FIG. 10(*b*) is a schematic side elevation thereof.
Figure 10B:
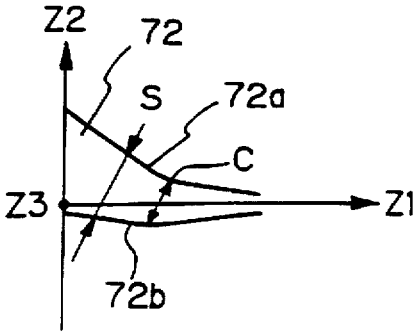
Figure 11A:
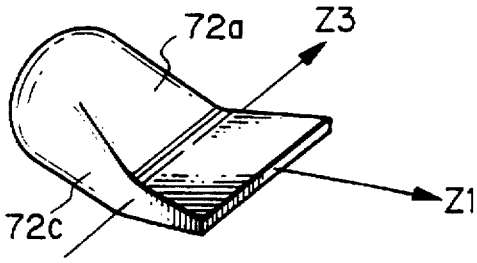
FIG. 11(*a*) is a perspective view of the second embodiment and FIG. 11(*b*) is a schematic plan view thereof.
Figure 11B:
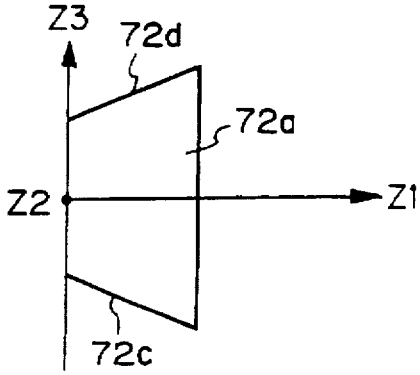
Figure 12:
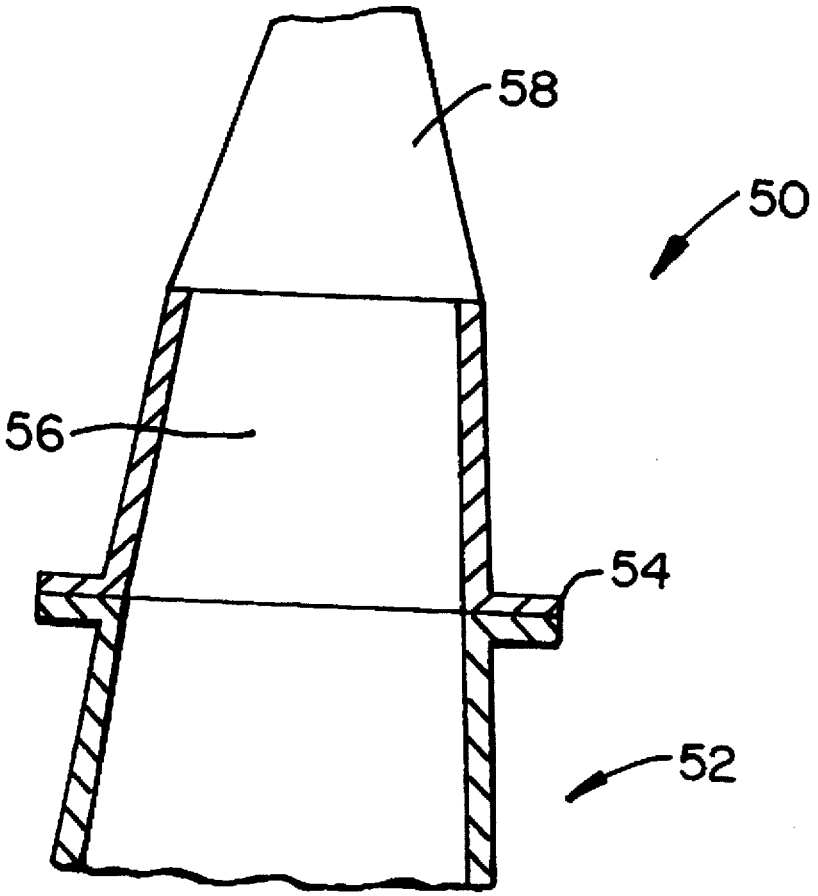
FIG. 12 is a front sectional view of the essential portion of the throat device shown in FIG. 7.

A throat device 70 of the second embodiment of the present invention is shown in FIG. 9 to FIG. 11. This throat device 70 is assumed to be on a horizontal plane and comprises a couple of throat sections 72, 74. The throat sections 72, 74 are formed in the same shape and therefore only the throat section 72 will be explained hereunder.

The left end of the throat section 72 in FIG. 10(*a*) is connected with a drive unit (not illustrated) and this throat section has a portion inclined downward in a vertical plane from the left end. The throat section 72 comprises an upper wall 72*a*, a lower wall 72*b*, and side walls 72*c* and 72*d*. The distance between the upper wall 72*a* and the lower wall 72*b*, namely a height S measured such as shown in FIG. 10(*b*) in the vertical plane, is gradually reduced from a line Z2 along a line Z1. The distance between the side walls 72*c*, 72*d* is gradually widened from a line Z3 along the line Z1 as partly shown in FIG. 11(*b*). This structure is introduced to provide a predetermined opening angle between the side walls in order to achieve a directivity control. When the shape of the throat section in the horizontal plane is determined, the distance between the upper and lower side walls is gradually reduced to such a value at which no adverse influence is exerted by bending the throat section. In this case, it should be considered that sectional area of the throat section 72 is not reduced along the line Z1.

The throat section 72 is slightly bent at a point (point C in FIG. 10(*b*) where the height S is above zero but less than about ½ the wavelength of a maximum reproduction frequency of the horn (not illustrated). In this case, it is recommended to bend the throat section at a point where the height S is as small as possible.

The right end portions of the throat sections 72, 74 constituted as described above are coupled with the left end portion of a combining member 76 shown in FIG. 9. The right end of the combining member 76 is connected with a horn (not illustrated).

In this throat section 70, it has been experimentally confirmed that a propagation path difference caused by bending the throat section results in substantially no phase intereference even at a maximum reproduction frequency of the horn because the height S at the bent points of the throat sections 72, 74 is set to less than about ½ the wavelength of the maximum reproduction frequency.

Since it is desirable that a bending angle is as small as possible, it is recommended to make the bending angle small so that the drive units connected to the throat sections 72, 74 do not contact with each other. It is further desirable in order to avoid an abrupt change in sectional area in the axial direction at the bent portions that the throat sections are bent smoothly rather than acutely.

In the above embodiments, two drive units are used and coupled to a horn, but it is possible that a throat device of the pressed invention interconnects three or more drive units and a horn. In this case, the number of branch members in the first embodiment or the number of throat sections in the second embodiment is set to be equal to the number of drive units.

As described above, according to the present invention, even if a high frequency sound wave is inputted to a throat device, highly efficient reproduction can be realized without any phase interference.

While there has been described what are at present considered to be preferred embodiments of the invention, it will be understood that various modifications may be made therein, with all such modifications (as fall within the true spirit and scope of the invention) being covered in the appended claims.

What is claimed is:

1. A throat device for interconnecting two drive units and a horn having a rectangular end, said device comprising:

a substantially straight body member having a rectangular end to be coupled with the rectangular end of the horn; and two first and second curved branch members coupled with the other end of said body member such that no phase interference occurs in a high frequency sound range; and wherein the horn has first, second, third, and fourth surfaces, defining a cross-section in a plane perpendicular to a direction of propagation of a sound wave, said cross-section having first, second, third, and fourth sides, said cross-section being rectangular wherein said first and second sides are shorter than said third, and fourth sides and wherein said first and second curved branch members branch from said body member along first and second axes, the first and second axes forming a plane that is parallel to said first and second sides of the rectangular cross-section.

2. The throat device as claimed in claim 1 wherein each of said first and second curved branch members has a first portion to be coupled to a drive unit and a second portion meeting said first portion at an obtuse angle, the branch members each defining a transverse sectional area at a segment where the first and second portions meet, the transverse sectional area having a height.

3. The throat device as claimed in claim 2 wherein the height of said transverse sectional area is less than ½ the wavelength of a maximum reproduction frequency of the horn.

4. A throat device for interconnecting two drive units and a horn having a rectangular end, said device comprising:

first and second branch means for receiving acoustic output from said drive units;

body means for receiving said acoustic output from said first and second branch means, said body means being substantially straight and having an end having a rectangular interface to be coupled with the rectangular end of the horn, the horn having first, second, third, and fourth surfaces, defining a cross-section in a plane perpendicular to a direction of propagation of a sound wave, said cross-section having first, second, third, and fourth sides, said cross-section being rectangular wherein said first and second sides are shorter than said third, and fourth sides, and wherein said first and second branch means branch from said body means along first and second axes, said first and second axes forming a plane that is parallel to said first and second sides of the rectangular cross-section.

5. A throat device for interconnecting two drive units and a horn having a rectangular end, said device comprising:

a substantially straight body member having first and second ends, the second end having a rectangular interface for coupling with the rectangular end of the horn and having a rectangular cross-section in a plane perpendicular to a direction of propagation of a sound wave, said cross-section having first, second, third, and fourth sides, wherein said first and second sides shorter than said third, and fourth sides, the body member defining upper and lower substantially straight walls extending from the first end to the second end and first and second sidewalls tapering outward from the first end to the second end;

first and second branch members coupled to the first end of said body member, said first and second curved branch members branching from said body member along first and second axes, the first and second axes forming a plane that is parallel to said first and second sides of the rectangular cross-section.

* * * * *